United States Patent [19]

Langen et al.

[11] 4,230,204

[45] Oct. 28, 1980

[54] CHECKOUT COUNTER WITH BAG DELIVERY MEANS

[75] Inventors: Marinus J. M. Langen, Rexdale; Edgars H. Strauss, Toronto, both of Canada

[73] Assignee: H. J. Langen & Sons Limited, Rexdale, Canada

[21] Appl. No.: 55,046

[22] Filed: Jul. 5, 1979

[51] Int. Cl.[3] ..... B65B 67/12

[52] U.S. Cl. ..... 186/66

[58] Field of Search ..... 186/1 V, 1 AA, 1 W, 186/1 M; 53/390

[56] References Cited

U.S. PATENT DOCUMENTS

| | | | |
|---|---|---|---|
| 3,025,651 | 3/1962 | Stanley | 186/1 V |
| 3,561,566 | 2/1971 | Potrafke | 186/1 AA |
| 4,020,618 | 5/1977 | Benzon-Peterson et al. | 186/1 V |

*Primary Examiner*—Stanley H. Tollberg
*Attorney, Agent, or Firm*—Fetherstonhaugh & Co.

[57] ABSTRACT

The checkout counter of the present invention is designed to locate an open bag in an ideal position in relation to a counter top of a packing station and to automatically deliver an open bag to the packing station from the bag dispenser which dispenses bags in a level below the optimum bag supporting position. The bag making machine is incorporated in the counter below the counter top and dispenses open bags at a level which is lower than the optimum level required for packing. An elevator mechanism is provided for receiving the bags from the bag making machine and elevating the bags to the required optimum level and the bags are transported along a support shelf at the required optimum level.

6 Claims, 6 Drawing Figures

CHECKOUT COUNTER WITH BAG DELIVERY MEANS

FIELD OF INVENTION

This invention relates to checkout counters. In particular this invention relates to a checkout incorporating a bag delivery system which delivers bags in an open configuration to a packing station.

The checkout counter of the present invention is closely related to that disclosed in copending application Ser. No. 958,429, filed Nov. 7, 1978 and preferably incorporates a bag making apparatus of the type described in copending application Ser. No. 910,737, filed May 30, 1978 now issued as U.S. Pat. No. 4,184,413, dated Jan. 22, 1980.

PRIOR ART

The paper or plastic bags used for packaging merchandise are generally opened by the checkout clerk at the level of the counter top and items are lifted from the counter top and deposited in the bag. In some previous proposals a well has been provided opening downwardly from the checkout counter at a fixed position along the length of the checkout counter, bags being located in an open position in the well so that items may be deposited therein without having to lift them to a height above the counter top in order to gain acess to the bag. All of these mechanisms have, however, required considerable manual manipulation on the part of the checkout clerk in order to open the bag or to maintain the bag in an open configuration or to move the bag away from the packing station after it is loaded.

The checkout counter of the present invention is designed to locate an open bag in an ideal position in relation to a counter top of a packing station and to automatically deliver the open bags to the packing station from a bag dispenser which dispenses bags at a level below the optimum bag supporting position.

Preferably the delivery mechanism is also adapted to cause the bags to be driven out of the packing station after they are loaded so as to be replaced by an empty bag.

SUMMARY OF INVENTION

According to one aspect of the present invention, a checkout counter comprises a counter top supported in a generally horizontally disposed first plane, said counter top having an input section extending inwardly from one end thereof toward the other end thereof and a packing section extending rearwardly from the input section, a packing platform extending longitudinally of said counter rearwardly from said input section in a generally horizontally disposed second plane spaced below said first plane to support an upwardly opening bag with its open end disposed at a convenient loading height with respect to said packing section, means in said counter below said input section adapted to dispense to an open bag in a generally upright upwardly opening configuration in a generally horizontally disposed third plane spaced below said second plane a distance sufficient to permit said bag to assume a generally upright configuration when disposed below said input section of said counter top, elevator means disposed adjacent said dispenser means for movement between a lowered position and a raised position, said elevator means being arranged to receive a bag dispensed into said third plane as aforesaid when in said lowered position and being operable to raise a bag from said third plane to said second plane when moved from said first position to said second position and means for moving a bag in a direction away from said input section toward said other end of said counter top.

The invention will be more clearly understood after reference to the following detailed specification read in conjunction with the drawings, wherein.

Figure 3:
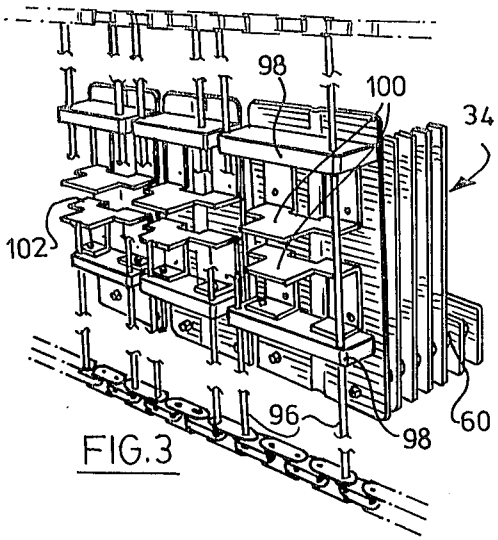
FIG. 3 is a pictorial back view of a plurality of transporter units mounted on the main conveyor of the checkout counter.

With reference to the drawings, the reference numeral 10 refers generally to a checkout counter constructed in accordance with an embodiment of the present invention. The counter 10 includes a counter top, generally identified by the reference numeral 12, which consists of an input section 14 and a packing section 16 which extends rearwardly from the input section. It will be noted that the input section 14 is relatively wide so as to provide a substantial area for receiving articles and the packing section 16 is relatively narrow so that the packer or checkout clerk positioned behind the counter does not have to reach over a wide counter top in order to deposit articles into the bags which are located at the front side of the counter as will be described hereinafter.

A conveyor belt 18 is mounted in the input section 14 of the counter top for movement in the direction of the arrow 20 to direct articles toward the checkout clerk. A corner section 22 is located above the conveyor belt 18 and has a side face angled toward the packing section of the counter top so that items which are driven along the input section of the counter top will be directed toward the outlet of the input section which opens into the packing section of the counter top.

The checkout counter 10 has a bag making machine incorporated in the enclosure 24 which is located below and extends rearwardly from the input section 14 in a manner as described in the applicant's copending application Ser. No. 910,737, filed May 30, 1978 now U.S. Pat. No. 4,184,413, the complete specification of which is incorporated herein by reference. The bag making machine is incorporated in the counter in the manner disclosed in our copending application Ser. No. 958,429 filed Nov. 7, 1978 the specification of which is incorporated herein by reference thereto. The bag making machine is adapted to dispense open bags 26 one at a time in a generally upright configuration into a bag holding station, generally identified by the reference numeral 28 wherein bags are held prior to delivery into a bag receiving station 29. A pusher mechanism 30 is provided for pushing the bags longitudinally of the counter in the direction of the arrow 32 onto a transporter generally identified by the reference numeral 34 which is located in the bag receiving station 29. The transporter 34 with the bag 26 thereon is then indexed in the direction of the longitudinal extent of the counter to an elevating station 36 wherein the transporter 34 is elevated in the direction of the arrow 38 to raise the bag 26 to the level of the platform 40. Thereafter, in a subsequent indexing, the bag 26 after loading is moved longitudinally in the direction of the arrow 42 toward the rear end of the counter. When, following several indexing movements of the transporter 34, it reaches the transporter lowering station 44 the transporter is lowered in the direction of the arrow 46 to be completely disposed below the platform 40 and to be subsequently redirected to the bag receiving station 29 as a result of successive indexing.

From the foregoing it will be seen that the checkout counter of the present invention permits a bag having a substantial overall height to be made and dispensed in an open upright configuration in the confines of the enclosure 24 which is formed below the level of the input section of the counter top which, by necessity, requires the open upper end of the bag 26 to be located at a level somewhat lower than that which is ideal for use in the packing station. By the provision of the elevator mechanism, the bags which are preformed at this lower level may be automatically elevated to the required optimum packing level and supported on a packing platform for movement therealong in a series of indexing steps controlled by the packer.

The bag making machine is completely housed within the counter so that none of the moving parts thereof constitute a hazard to the shopper or the checkout clerk. The bags emerge from below the input section 18 through a passageway 48 formed at the back end thereof.

The platform 40 and its associated back rest wall 50 are stationary members and are disposed at 90° to one another and are each angularly inclined with respect to the horizontal plane so that bags resting on the platform will be directed under the influence of gravity toward the back rest wall 50 and will not tend to fall off of the platform 40 in the forward direction.

Figure 2:
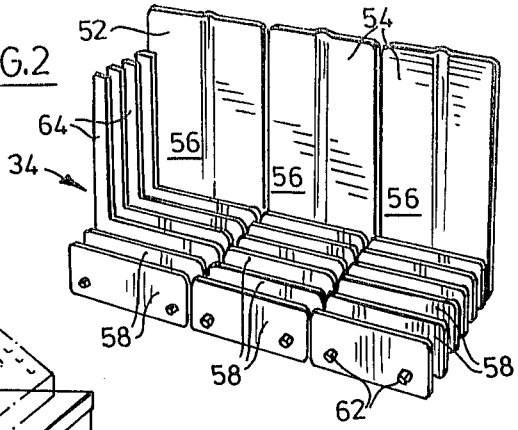
FIG. 2 is a pictorial front view of a transporter unit for use in transporting bags along the checkout counter.
Figure 1:
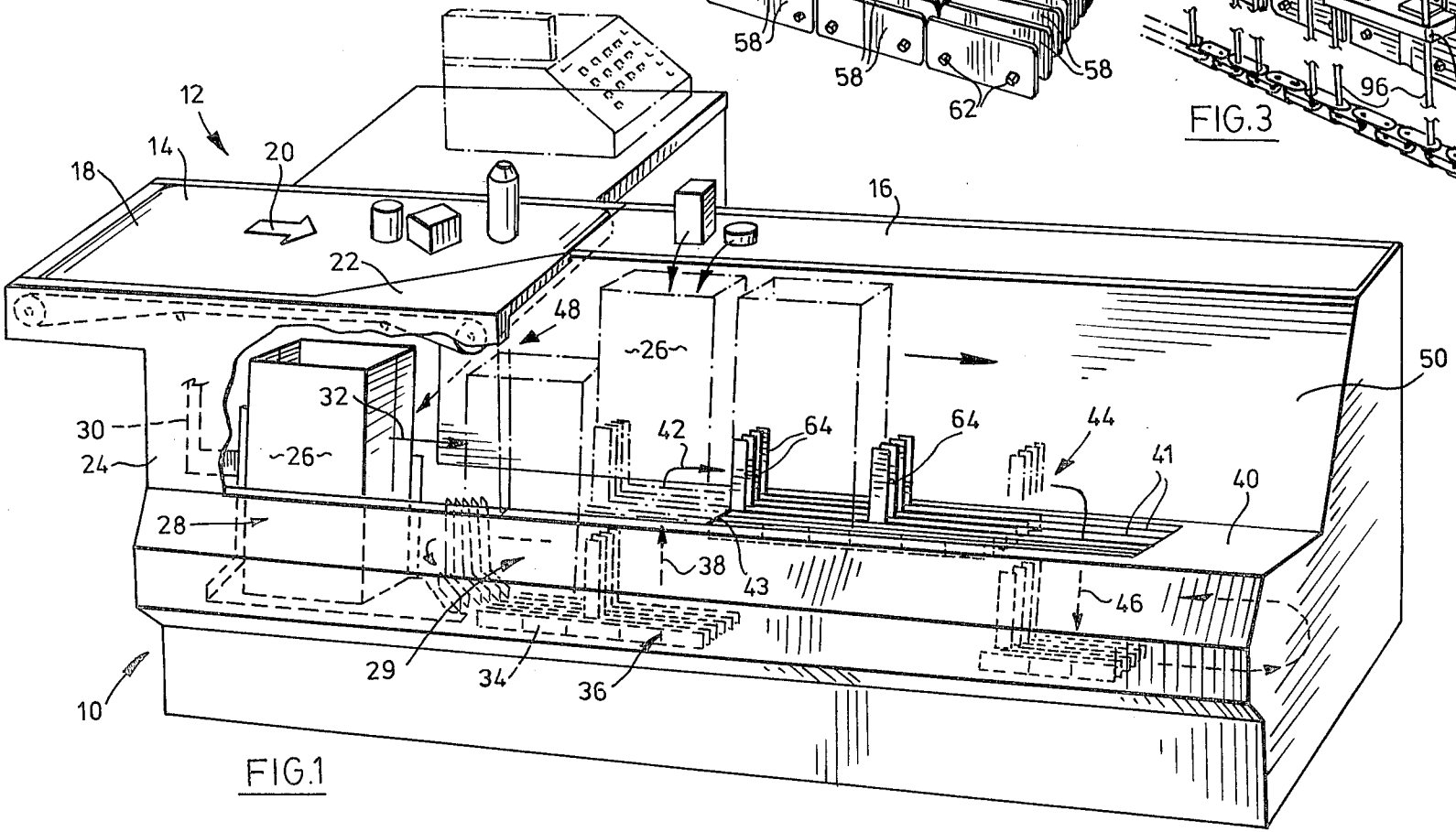
FIG. 1 is a pictorial front view, partially sectioned, of a checkout counter constructed in accordance with an embodiment of the present invention.

The transporters 34 are best illustrated in FIG. 2 of the drawings. Each transporter 34 is made up of a plurality of articulated segments, two of which are identical and identified by the reference numeral 54 and the other of which is a pusher segment identified by the reference numeral 52. The segments 52 and 54 each have a back wall panel 56 and a plurality of bottom wall panels 58 which are vertically oriented and maintained in a spaced parallel relationship by means of spacers 60 (FIG. 3) which are mounted between each adjacent plate and secured by clamping posts 62. The plates 58 of the pusher segment 52, are distinguished from those of the other segments 54 by the provision of pusher fingers 64 which project upwardly from the trailing end of at least some. The fingers 64 are omitted from the front two plates 58 to provide clearance to facilitate the entry of a bag to the transporter when the transporter is located in the bag receiving station 28 (FIG. 1) as shown in broken lines wherein the segment 52 has not extended fully around the direction reversing corner of the main conveyor.

The checkout counter 10 (FIG. 6) includes a base structure 70 from which a plurality of posts 72 extend upwardly. The main conveyor 31 (FIG. 4) has a frame 74 which includes a pair of elongated plates 76 which are maintained in a spaced parallel relationship by means of a plurality of support posts 78. Sprockets 80 are located at opposite ends of the plates 76 by support brackets 82. The sprockets 80 at each end of the frame 74 are mounted for rotation about axes 84 and are connected to one another by means of a shaft 86. Endless chains 88 extend around oppositely disposed sprockets 80 and along slipways 90 formed between the side edges of the plates 76 and outrigger rails 92 which are supported by a plurality of bridge pieces 94 which are mounted on the plates 76. A plurality of support rails or rods 96 extend between the spaced parallel chains 88 in a direction normal to the direction of travel of the chains. The support rails 96 serve to support and guide the segments 52 and 54 of the transporters 34.

As shown in FIG. 3 of the drawings, the back plates 56 of the segments 52 and 54 of the transporters each have a pair of guide brackets 98 projecting rearwardly therefrom. Each guide bracket 98 has passages formed adjacent each end thereof to receive a pair of spaced support rails 96. The passages formed in the brackets 98 permit the transporter 34 to slide freely along the support rails 96. The position in which the transporter 34 is retained in relation to the main conveyor is determined by a machanism which includes track engaging brackets 100 which are secured to the back face of each back panel 56 of the segments 52 and 54 of the transporter and form a guide channel or slipway 102 therebetween.

Figure 4:
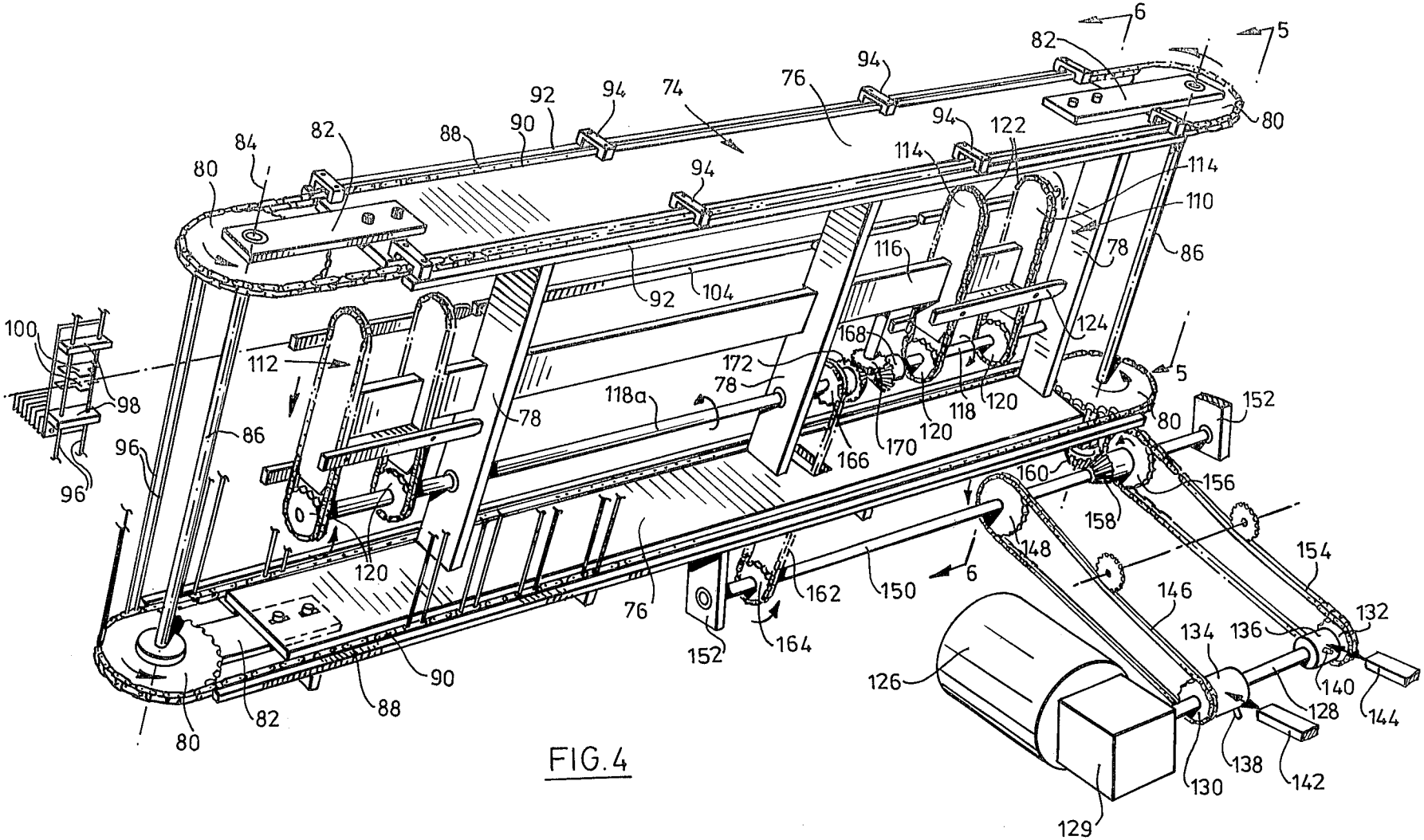
FIG. 4 is a pictorial view of the main conveyor viewed from the rear.
Figure 5:
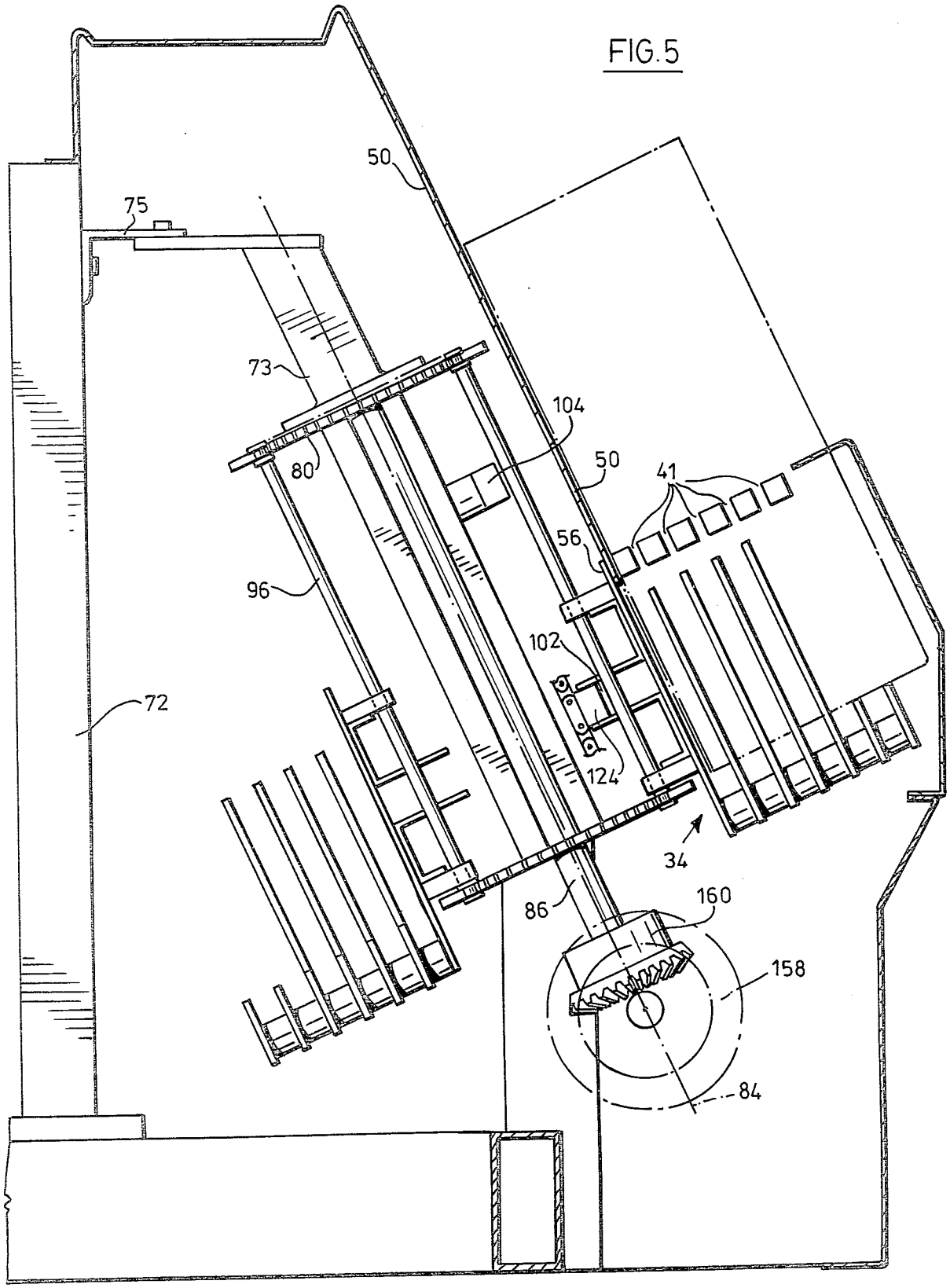
FIG. 5 is a partially sectioned end view of the checkout counter incorporating the main conveyor taken in the direction of the arrows 5—5 of FIG. 4.

As shown in FIGS. 4 and 5 of the drawings, a guide track 104 extends longitudinally of the outer face of the support frame in a direction parallel to the forward run of the chains 88. It will be noted that the guide track 104 does not extend over the full length of the main conveyor. It terminates short of the elevator station 36 and short of the lowering station 44.

The mechanism which is used for raising the bag transporters, generally identified as the elevator mechanism 110, is constructed in a manner identical to the mechanism used for lowering the bag transporters, which is generally identified by the reference numeral 112, and consequently only one of these mechanisms will be described in detail.

The elevator mechanism 110 includes a pair of spaced parallel guide plates 114 supported by a longitudinally extending beam member 116 which is in turn supported by the cross posts 78. A drive shaft 118 is journalled in the posts 78 and has sprockets 120 secured thereto. Endless chains 122 extend around the sprockets 120 and guide plates 114 in a spaced parallel relationship. Three transverse support members 124 are located at spaced intervals along the chains 128 so as to be selectively alignable with the slipway 102 of the transporters 34 when the transporters are in the lowered position shown in FIG. 5 and with the guide rail 104 when the transporters 34 are in the elevated position shown in FIG. 6 of the drawings.

The main conveyor, elevator mechanism and lowering mechanism are driven by a common motor 126 which drives a primary output shaft 128 through a reduction gear box 129. The shaft 128 has sprockets 130 and 132 mounted thereon by means of clutches 134 and 136, respectively. The clutch 134 has a stop pin 138 and the clutch 136 has a stop pin 140. A clutch release bar 142 is mounted for movement into and out of the path of the stop pin 138 and a clutch release bar 144 is mounted for movement into and out of the path of travel of the clutch pin 140. The clutches 134 and 136 and their associated release bar 142 and 144 serve to permit selective operation of the main conveyor and the elevator/lowering mechanisms.

A chain 146 extends around the sprocket 130 and a further sprocket 148 which is secured to the drive shaft 150 which is in turn journalled in support posts 152. A chain 154 extends around the sprocket 132 and the sprocket 156 which is mounted for rotation about the drive shaft 150. The sprockets 156 has a bevelled gear 158 keyed thereto which meshes with a bevelled gear 160 located at the end of the shaft 86. Thus, the shaft 86 and the chains 88 which are carried by the sprockets 80 which are supported by the shaft 86 may be driven by the motor 126 when the clutch stop 144 is withdrawn.

Power is transmitted to the elevator mechanism and the lowering mechanism from the drive shaft 150 by way of a drive chain 62 which extends around sprockets 164 and 166. The sprocket 166 is keyed to the shaft 118*a* upon which the sprockets 120 of the lowering mechanism 112 are keyed. The shaft 118 of the elevator mechanism is connected to the shaft 118*a* through bevelled gears 168, 170 and 172 of which the bevelled gear 170 is an idler gear. The bevelled gears 168, 170 and 172 serve to ensure that the shaft 118 is driven in a direction opposite to the direction of rotation of the shaft 118*a* such that when the elevator mechanism is driven to elevate the transporters, the lowering mechanism 112 is simultaneously driven in the opposite direction to lower the transporters.

Figure 6:
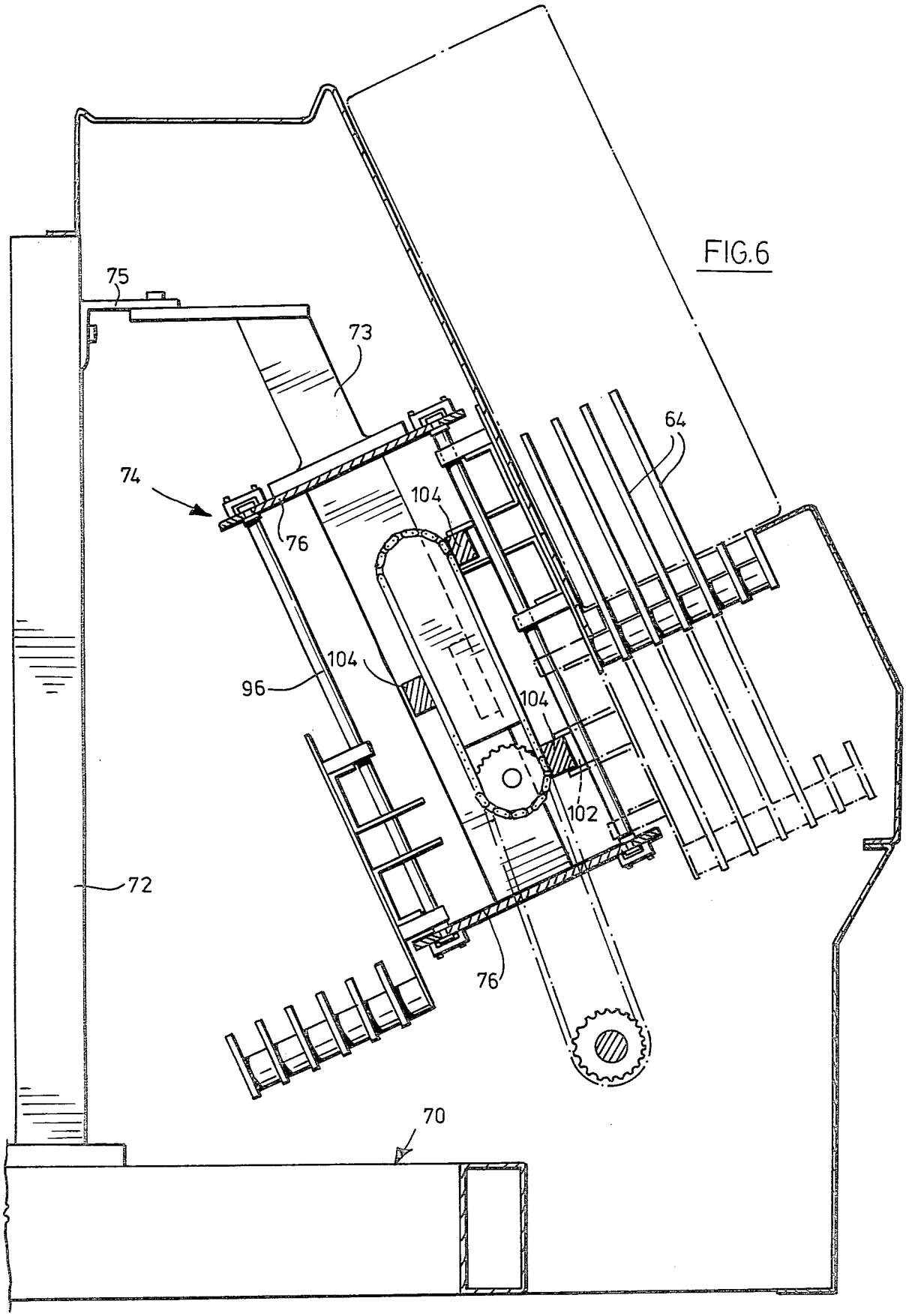
FIG. 6 is a partially sectioned end view similar to FIG. 5 taken in the direction of the arrows 6—6 of FIG. 4.

As shown in FIGS. 5 and 6 of the drawings, the frame 74 of the main conveyor is supported by brackets 73 arranged at spaced intervals along the upper plate 76 from an angle iron member 75 which extends longitudinally between support posts 72. The frame 74 is supported with the longitudinal axis 84 of the shafts 86 extending parallel to the back rest wall 50 of the counter and with the back panels 56 of the carriages which are located at the forward run of the conveyor disposed inwardly from the back rest wall 50.

The platform 40 has a plurality of longitudinally elongated passages 41 extending inwardly from the front edge 43 thereof through which the finger portions 64 of the transporter member project when the transporters are in the elevated position.

In use, when the main conveyor is at rest one of the transporters 34 will be located in the bag receiving station with the segment 52 thereof supported by a portion of the main drive chains 88 which are extending around the arc of curvature of the sprockets 84 so that the fingers 64 are spaced rearwardly from the path of travel of the bag 26 as it is transferred from the station 28 to the station 29 in the direction of the arrow 32. Thereafter, the transporter with the bag 26 mounted thereon is driven by the power transmission means previously described to the elevator station 36 and when in the elevator station 36 the transporter is elevated to the raised position to locate the open bag 26 at the optimum level for packing in which the bottom end thereof is located at the level of the platform 40. It will be noted that during the step of elevating the first bag, a subsequent bag is transported laterally from the bag forming station to the bag receiving station 28 to be located on the next following bag transporter. After the first bag 26 has been filled, the operator activates the appropriate control mechanism which may be in the form of a foot pedal to effect a further indexing which advances the first bag rearwardly of the counter away from the packing station and positions a subsequent bag in the required packing station.

From the foregoing it will be apparent that the apparatus of the present invention provides a mechanism which will operably position an open bag in the packing station of a checkout counter at a convenient height for packing while permitting bags to be constructed and dispensed at a remote area disposed at a level below the optimum packing level.

These and other advantages of the apparatus will be apparent to those skilled in the art.

What I claim as my invention is:

1. A checkout counter comprising:

(a) a counter top supported in a generally horizontally disposed first plane, said counter top having an input section extending inwardly from one end thereof toward the other end thereof and a packing section extending rearwardly from the input section, (b) a packing platform extending longitudinally of said counter rearwardly from said input section in a generally horizontally disposed second plane spaced below said first plane to support an upwardly opening bag with its open end disposed at a convenient loading height with respect to said packing section, (c) means in said counter below said input section adapted to dispense an open bag in a generally upright upwardly opening configuration in a generally horizontally disposed third plane spaced below said second plane a distance sufficient to permit said bag to assume a generally upright configuration when disposed below said input section of said counter top, (d) elevator means disposed adjacent said dispenser means for movement between a lowered position and a raised position, said elevator means being arranged to receive a bag dispensed into said third plane as aforesaid when in said lowered position and being operable to raise a bag from said third plane to an elevated position in which it is supported in said second plane in alignment with said packing platform when said elevator means is moved from said first position to said second position; and (e) conveyor means extending along said packing platform and adapted to engage a bag disposed in said elevated position and drive it in a direction away from said input section along the packing platform toward said other end of said counter top.

2. A checkout counter comprising:

(a) a counter top supported in a generally horizontally disposed first plane, said counter top having an input section extending inwardly from one end thereof toward the other end thereof and a packing section extending rearwardly from the input section, (b) a packing platform extending longitudinally of said counter rearwardly from said input section in a generally horizontally disposed second plane spaced below said first plane to support an upwardly opening bag with its open end disposed at a convenient loading height with respect to said packing section, (c) means in said counter below said input section adapted to dispense an open bag in a generally upright upwardly opening configuration into a bag receiving station disposed in a third plane spaced below said second plane a distance sufficient to permit said bag to assume a generally upright configuration and disposed below said input section of said counter top, (d) conveyor means mounted below said counter top for movement in the direction of the longitudinal extent of said packaging platform, (e) a plurality of bag transporters each having a support face arranged to underlie and support a bag when the bag is in said generally upright configuration, said transporters being mounted on said conveyor so as to be carried by said conveyor through said bag receiving station and along said packing platform, each bag transporter being mounted for movement relative to said conveyor between a lowered position in which the support face thereof is disposed in said third plane and a raised position in which the support face thereof is disposed in said second plane, and (f) means for raising and lowering said bag transporters between said lowered and raised positions to locate each transporter in the lowered position when driven into and through said bag receiving station and to elevate each transporter to said raised position after it is driven rearwardly from said input section of said counter top.

3. A checkout counter as claimed in claim 2 wherein said conveyor means comprises:

(a) a frame, (b) a pair of endless chains arranged one above the other and supported by said frame for movement in a spaced parallel relationship, said chains having a forward run extending from said bag receiving station in a direction parallel to said platform, said forward run extending through an elevating station disposed adjacent said bag receiving station and a lowering station disposed more closely adjacent said other end of said platform, (c) a guide track mounted on said frame and extending between said elevating station and said lowering station for supporting said transporters in said elevated position as they are driven along said forward run between said elevating station and said lowering station, (d) a plurality of support rails extending between said endless chains, (e) said bag transporters being mounted on said support rails for independent movement thereon so as to be guided during movement between said raised and lowered positions, (f) track engaging means on each transporter for engaging said guide track to support said transporters thereon, (g) said means for raising and lowering said bag transporters comprising elevator means disposed in said elevating station and lowering means disposed in said lowering station, said elevator means and said lowering means each comprising at least one support member mounted for movement between a first position aligned with said guide track means to permit said track engaging means to transfer to and from said support member and said guide track means and a second position in which said support member supports a transporter in the position in which the transporter is located when in said lowered position.

4. A checkout counter as claimed in claim 2 wherein said platform has a plurality of longitudinally elongated slots extending therethrough, and each of said transporters has a plurality of pusher fingers extending upwardly therefrom, said pusher fingers being disposed below said platform when said transporters are in said lowered position and projecting upwardly through said slots in said platform when said transporters are in said raised position for moving bags along said platform in use.

5. A checkout counter as claimed in claim 2 wherein said input section of said counter top is wider than said packing section and projects forwardly therefrom.

6. A checkout counter comprising:

(a) a counter top supported in a generally horizontally disposed first plane, said counter top having an input section extending inwardly from one end thereof toward the other end thereof and a packing section extending rearwardly from the input section, (b) a packing platform extending longitudinally of said counter rearwardly from said input section in a generally horizontally disposed second plane spaced below said first plane to support an upwardly opening bag with its open end disposed at a convenient loading height with respect to said packing section, (c) means in said counter below said input section adapted to dispense an open bag in a generally upright upwardly opening configuration into a bag receiving station disposed in a third plane spaced below said second plane a distance sufficient to permit said bag to assume a generally upright configuration and disposed below said input section of said counter top, (d) conveyor means mounted below said counter top for movement in the direction of the longitudinal extent of said packing platform, (e) a plurality of bag transporters each having a support face arranged to underlie and support a bag when the bag is in said generally upright configuration, said transporters being mounted on said conveyor so as to be carried by said conveyor through said bag receiving station and along said packing platform, each bag transporter being mounted for movement relative to said conveyor between a lowered position in which the support face thereof is disposed in said third plane and a raised position in which the support face thereof is disposed in said second plane, and (f) means for raising and lowering said bag transporters between said lowered and raised positions to locate each transporter in the lowered position when driven into and through said bag receiving station and to elevate each transporter to said raised position after it is driven rearwardly from said input section of said counter top, (g) said platform having a plurality of longitudinally elongated slots extending therethrough, and each of said transporters has a plurality of pusher fingers extending upwardly therefrom, said pusher fingers being disposed below said platform when said transporters are in said lowered position and projecting upwardly through said slots in said platform when said transporters are in said raised position for moving bags along said platform in use.

* * * * *